US010863770B2

(12) United States Patent
Mironov et al.

(10) Patent No.: US 10,863,770 B2
(45) Date of Patent: Dec. 15, 2020

(54) AEROSOL-GENERATING SYSTEM AND AEROSOL-GENERATING ARTICLE FOR USE IN SUCH A SYSTEM

(71) Applicant: PHILIP MORRIS PRODUCTS S.A., Neuchatel (CH)

(72) Inventors: Oleg Mironov, Cudrefin (CH); Ihar Nikolaevich Zinovik, Peseux (CH); Oleg Fursa, Gempenach (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 239 days.

(21) Appl. No.: 15/738,914

(22) PCT Filed: Aug. 16, 2016

(86) PCT No.: PCT/EP2016/069361
§ 371 (c)(1),
(2) Date: Dec. 21, 2017

(87) PCT Pub. No.: WO2017/029269
PCT Pub. Date: Feb. 23, 2017

(65) Prior Publication Data

US 2018/0168226 A1 Jun. 21, 2018

(30) Foreign Application Priority Data

Aug. 17, 2015 (EP) ..... 15181193

(51) Int. Cl.

| | |
|---|---|
| ***A24F 47/00*** | (2020.01) |
| ***A24B 15/16*** | (2020.01) |
| ***H05B 6/10*** | (2006.01) |
| ***A24B 15/167*** | (2020.01) |

(52) U.S. Cl.
CPC ..... *A24F 47/008* (2013.01); *A24B 15/167* (2016.11); *H05B 6/108* (2013.01)

(58) Field of Classification Search
CPC .... A24F 47/008; A24F 15/015; A24B 15/167; H05B 6/105; H05B 6/108
(Continued)

(56) References Cited

U.S. PATENT DOCUMENTS 5,613,505 A * 3/1997 Campbell ..... A24F 47/008 131/194
10,085,482 B2 * 10/2018 Silvestrini ..... A24B 15/16
(Continued)

FOREIGN PATENT DOCUMENTS

CN 102355914 A 2/2012
CN 204519365 U 8/2015
(Continued)

OTHER PUBLICATIONS

PCT Search Report and Written Opinion for PCT/EP2016/069361 dated Nov. 4, 2016 (12 pages).
(Continued)

*Primary Examiner* — Paul R Durand
*Assistant Examiner* — Andrew P Bainbridge
(74) *Attorney, Agent, or Firm* — Oblon, McClelland, Maier & Neustadt, L.L.P.

(57) ABSTRACT

The aerosol-generating system comprises a nicotine source, a second substance source and a susceptor (2) for heating the nicotine source and the second substance source. The system further comprises a power source connected to a load network, the load network comprising an inductor for being inductively coupled to the susceptor. The invention also relates to an aerosol-generating article comprising a cartridge comprising a first compartment (11) with a nicotine source and a second compartment (12) with a second substance source and a susceptor arranged between the first compartment and the second compartment.

20 Claims, 2 Drawing Sheets

(58) Field of Classification Search
USPC ..... 219/628–630, 634–635, 645
See application file for complete search history.

(56) References Cited

U.S. PATENT DOCUMENTS

| | | | | |
|---|---|---|---|---|
| 10,362,804 | B2 * | 7/2019 | Bessant | A24F 47/008 |
| 2016/0022930 | A1 * | 1/2016 | Greim | A61M 15/06 131/328 |
| 2016/0158397 | A1 * | 6/2016 | Duffield | A01M 1/2061 219/634 |
| 2017/0196269 | A1 * | 7/2017 | Bernauer | A24F 47/008 |
| 2017/0215477 | A1 * | 8/2017 | Reevell | A24F 47/008 |
| 2018/0192700 | A1 * | 7/2018 | Fraser | A24F 40/465 |
| 2019/0239555 | A1 * | 8/2019 | Nicholson | A24F 47/008 |
| 2020/0068953 | A1 * | 3/2020 | Rogan | A24F 47/008 |

FOREIGN PATENT DOCUMENTS

| | | | |
|---|---|---|---|
| EP | 2444112 | | 4/2012 |
| JP | 3588469 | B2 | 8/2004 |
| JP | 2016-515402 | A | 5/2016 |
| JP | 2016/516402 | A | 6/2016 |
| JP | 2018/524983 | A | 9/2018 |
| JP | 6496312 | B2 | 3/2019 |
| WO | WO 2014/048745 | | 4/2014 |
| WO | WO 2014/139611 | | 9/2014 |
| WO | WO 2015/000974 | | 1/2015 |
| WO | WO 2015/038981 | | 3/2015 |

OTHER PUBLICATIONS

Third Party Observations, in corresponding Japanese Application No. 2017-566321 dated Jul. 17, 2020 (33 pages).

Notification of the Second Office Action dated Aug. 20, 2020 in corresponding Chinese Patent Application No. 201680037797.X (with English translation)(18 pages).

Notice of Grounds for Rejection dated Aug. 31, 2020 in corresponding Japanese Patent Application No: 2017-566308 (with English translation)(4 pages).

* cited by examiner

AEROSOL-GENERATING SYSTEM AND AEROSOL-GENERATING ARTICLE FOR USE IN SUCH A SYSTEM

This application is a U.S. National Stage Application of International Application No. PCT/EP2016/069361, filed Aug. 16, 2016, which was published in English on Feb. 23, 2017, as International Publication No. WO 2017/029269 A1. International Application No. PCT/EP2016/069361 claims priority to European Application No. 15181193.2, filed Aug. 17, 2015.

The invention relates to inductively heated aerosol-generating systems comprising a nicotine source for generating an aerosol comprising nicotine. The invention also relates to an aerosol-generating article comprising a nicotine source for use in such an aerosol-generating system.

Devices for delivering nicotine to a user comprising a nicotine source and a delivery enhancing source are known. Different vapour pressures of the substances used in these systems, for example nicotine and pyruvic acid, may require individual heating of the different substances in order to achieve an efficient reaction stoichiometry. However, this may increase complexity of a device.

Thus, there is need for an aerosol-generating system comprising a nicotine source having a simple heating mechanism. In particular, there is need for such an aerosol-generating system and aerosol-generating article to be used in such a system that enables an efficient heating.

According to an aspect of the present invention, there is provided an aerosol-generating system. The aerosol-generating system comprises a nicotine source, a second substance source and a susceptor for heating the nicotine source and the second substance source. Preferably, the susceptor is a single susceptor. The aerosol-generating system further comprises a power source connected to a load network. The load network comprises an inductor for being inductively coupled to the susceptor, preferably to the single susceptor.

One susceptor for heating the nicotine source and the second substance source simplifies arrangement and manufacture of an aerosol-generating system. One susceptor for heating both substances may also facilitate operation of the system. In the system according to the invention, only one susceptor needs to be provided and operated. Control of an evaporation efficiency of the two substances and thus control of a reaction stoichiometry may be achievable by a heating control of one susceptor only, for example through temperature control of the one susceptor.

Preferably, the inductor comprised in the load network of the aerosol-generating system according to the invention is a single induction coil. This additionally enables a simple device construction and device electronics, as well as simple operation of the system. With a single inductor, one operation mode of the inductor allows heating of the susceptor. The heating of two substances is made available through the provision of one susceptor assigned to both sources. In addition, aerosol-generating devices for use with nicotine containing cartridges may be adapted to inductive heating. Such device may, for example, be provided with an electronics and load network including an inductor. Thus, such devices may be manufactured, requiring less power than conventionally heated devices, for example comprising heating blades, and providing all advantages of contactless heating (for example, no broken heating blades, electronics separated from heating element and aerosol-forming substances, facilitated cleaning of the device). Since a susceptor is generally an element of a disposable portion of the system, contamination or cleaning of the susceptor as heating element is no issue in the system according to the invention.

Advantageously, the susceptor is configured to heat the nicotine source and the second substance source to substantially a same temperature.

As used herein, by "substantially a same temperature" it is meant that the difference in temperature of the nicotine source and the second substance source measured at corresponding locations relative to the susceptor is less than about 3 degree Celsius. Preferably, the susceptor is configured to heat the nicotine source and the second substance source to a same temperature.

However, the susceptor may also configured to heat the nicotine source and the second substance source to different temperatures. This may, for example, be achieved by varying the size of a contact surface of the susceptor with the nicotine source and with the second substance source. For example, if the nicotine source shall be heated to higher temperatures than the second substance source (or vice versa), the size of the contact surface between susceptor and nicotine source may be larger than the contact surface between the susceptor and the second substance source (or vice versa). Varying sizes of contact surfaces may be achieved through various means. It may be achieved, for example, through a selective provision of thermally insulating material on one side of a susceptor or through a specific construction of a compartment a source is arranged in as will be described further below.

The susceptor may be in direct contact, preferably in direct physical contact, with at least one of the nicotine source and the second substance source. Preferably, the susceptor is in direct contact, preferably in direct physical contact, with both, the nicotine source and the second substance source.

A direct contact, in particular a direct physical contact, may reduce or entirely omit thermal losses between heating element and source to be heated. Thus, a direct contact may provide for a very efficient heating of the sources.

As used herein, the term "susceptor" refers to a material that is capable to convert electromagnetic energy into heat. When located in an alternating electromagnetic field, typically eddy currents are induced and hysteresis losses occur in the susceptor causing heating of the susceptor. As the susceptor is located at least in thermal contact or close thermal proximity with the nicotine source or the second substance source, the respective sources are heated by the respective susceptor such that a vapour is formed. Preferably, the susceptor is arranged in direct physical contact with the respective sources.

The susceptor may be formed from any material that can be inductively heated to a temperature sufficient to vaporize nicotine and the second substance. Preferred susceptors comprise a metal or carbon. A preferred susceptor may comprise or consist of a ferromagnetic material, for example ferritic iron, a ferromagnetic alloy, such as ferromagnetic steel or stainless steel, a ferrite. A suitable susceptor may comprise aluminium. The susceptor preferably comprises more than 5%, preferably more than 20%, preferably more than 50% or 90% of ferromagnetic or paramagnetic materials.

Preferred susceptors may be heated to a temperature in excess of 50 degrees Celsius. In use with the system according to the invention, susceptors may be heated to temperatures in preferred ranges of: 30 and 150 degree Celsius, 35 and 140 degree Celsius, 45 and 130 degree Celsius, 65 and 120 degree Celsius, and 80 and 110 degree Celsius. Suitable susceptors may comprise a non-metallic core with a metal layer disposed on the non-metallic core, for example metallic tracks formed on a surface of a ceramic core. A susceptor may have a protective external layer, for example a protective ceramic layer or protective glass layer encapsulating the susceptor. The susceptor may comprise a protective coating formed by a glass, a ceramic, or an inert metal, formed over a core of susceptor material.

A susceptor may be a metallic elongate material.

If a susceptor profile is of constant cross-section, for example a circular cross-section, it has a preferable width or diameter of between about 1 millimeter and about 5 millimeter. If the susceptor profile has the form of a sheet or band, the sheet or band preferably has a rectangular shape having a width preferably between about 2 millimeter and about 8 millimeter, more preferably, between about 3 millimeter and about 5 millimeter, for example 4 millimeter and a thickness preferably between about 0.03 millimeter and about 0.15 millimeter, more preferably between about 0.05 millimeter and about 0.09 millimeter, for example about 0.07 millimeter.

As a general rule, whenever the term "about" is used in connection with a particular value throughout this application this is to be understood such that the value following the term "about" does not have to be exactly the particular value due to technical considerations. However, the term "about" used in connection with a particular value is always to be understood to include and also to explicitly disclose the particular value following the term "about".

The nicotine source may comprise one or more of nicotine, nicotine base, a nicotine salt, such as nicotine-HCl, nicotine-bitartrate, or nicotine-ditartrate, or a nicotine derivative. The nicotine source may comprise natural nicotine or synthetic nicotine. The nicotine source may comprise pure nicotine, a solution of nicotine in an aqueous or non-aqueous solvent or a liquid tobacco extract.

The nicotine source may further comprise an electrolyte forming compound. The electrolyte forming compound may be selected from the group consisting of alkali metal hydroxides, alkali metal oxides, alkali metal salts, alkaline earth metal oxides, alkaline earth metal hydroxides and combinations thereof. For example, the nicotine source may comprise an electrolyte forming compound selected from the group consisting of potassium hydroxide, sodium hydroxide, lithium oxide, barium oxide, potassium chloride, sodium chloride, sodium carbonate, sodium citrate, ammonium sulphate and combinations thereof.

The nicotine source may comprise an aqueous solution of nicotine, nicotine base, a nicotine salt or a nicotine derivative and an electrolyte forming compound.

The nicotine source may further comprise other components including, but not limited to, natural flavours, artificial flavours and antioxidants.

The nicotine source may comprise a sorption element and nicotine sorbed on the sorption element. Preferably, the susceptor is in physical contact with the sorption element of the nicotine source. The susceptor may at least partially be embedded in the sorption element of the nicotine source.

The sorption element may be formed from any suitable material or combination of materials. For example, the sorption element may comprise one or more of glass, cellulose, ceramic, stainless steel, aluminium, polyethylene (PE), polypropylene, polyethylene terephthalate (PET), poly (cyclohexanedimethylene terephthalate) (PCT), polybutylene terephthalate (PBT), polytetrafluoroethylene (PTFE), expanded polytetrafluoroethylene (ePTFE), and BAREX®.

The sorption element may be a porous sorption element. For example, the sorption element may be a porous sorption element comprising one or more materials selected from the group consisting of porous plastic materials, porous polymer fibres and porous glass fibres.

The sorption element is preferably chemically inert with respect to nicotine.

The sorption element may have any suitable size and shape.

The sorption element may be a substantially cylindrical plug. For example, the sorption element may be a porous substantially cylindrical plug.

The sorption element may be a substantially cylindrical hollow tube. For example, the sorption element may be a porous substantially cylindrical hollow tube.

The size, shape and composition of the sorption element may be chosen to allow a desired amount of nicotine to be sorbed on the sorption element.

The sorption element advantageously acts as a reservoir for the nicotine.

The second substance is a delivery enhancing compound or substance to react with nicotine vapour. The nicotine vapour reacts with the second substance vapour in the gas phase to form an aerosol. The formed aerosol is delivered to a downstream end of an aerosol-generating article and to a user.

The delivery enhancing compound may be an acid. The delivery enhancing compound may be an acid selected from the group consisting of 3-methyl-2-oxovaleric acid, pyruvic acid, 2-oxovaleric acid, 4-methyl-2-oxovaleric acid, 3-methyl-2-oxobutanoic acid, 2-oxooctanoic acid, 2-oxopropanoic acid (lactic acid) and combinations thereof. Preferably, the delivery enhancing compound is lactic acid.

The second substance source, for example comprising a lactic acid source, may comprise a sorption element and a second substance, for example lactic acid, sorbed on the sorption element. Preferably, the susceptor is in physical contact with the sorption element of the second substance. The susceptor may at least partially be embedded in the sorption element of the second substance.

The sorption element may be formed from any suitable material or combination of materials, for example those listed above.

The sorption element is preferably chemically inert with respect to the second substance.

The sorption element may have any suitable size and shape.

The sorption element for the second substance may have a same form, material and size as described above for the sorption element for the nicotine. In particular, the two sorption elements may be identical.

The size, shape and composition of the sorption element may be chosen to allow a desired amount of second substance to be sorbed on the sorption element.

The sorption element advantageously acts as a reservoir for the second substance.

Preferably, the second substance source is a lactic acid source and an aerosol generated in the aerosol-generating system comprises nicotine lactate acid salt particles.

The vapour pressures of lactic acid and nicotine as function of temperature are similar. Inclusion of these two reactants having a similar volatility in the aerosol-generating system and the aerosol-generating article according to the present invention advantageously allows an efficient reaction stoichiometry to be achieved by heating the nicotine source and the lactic acid source to substantially the same temperature using a single susceptor. As described and illustrated further below, this enables the nicotine source and the lactic acid source to be stored and heated in two compartments in a single component within the aerosol-generating system and the aerosol-generating article according to the present invention. This advantageously reduces the complexity and cost of manufacturing the aerosol-generating system and the aerosol-generating article according to the present invention.

Heating the nicotine source and the lactic acid source to a temperature above ambient temperature using a single susceptor allows control of the amount of nicotine vapour and lactic acid vapour released from the nicotine source and the lactic acid source, respectively. This advantageously enables the vapour concentrations of the nicotine and the lactic acid to be controlled and balanced proportionally to yield an efficient reaction stoichiometry. This advantageously improves the efficiency of the formation of an aerosol and the consistency of nicotine delivery to a user. It also advantageously reduces the risk of undesired delivery of excess reactant, that is unreacted nicotine vapour or unreacted lactic acid vapour, to a user.

Preferably, the aerosol-generating system according to the present invention comprises a proximal end through which, in use, an aerosol exits the aerosol-generating system for delivery to a user. The proximal end may also be referred to as the mouth end. In use, preferably, a user draws on the proximal end of the aerosol-generating system. The aerosol-generating system preferably comprises a distal end opposed to the proximal end.

Typically when a user draws on the proximal end of the aerosol-generating system, air is drawn into the aerosol-generating system, passes through the aerosol-generating system and exits the aerosol-generating system at the proximal end. Components, or portions of components, of the aerosol-generating system may be described as being upstream or downstream of one another based on their relative positions between the proximal end and the distal end of the aerosol-generating system.

As used herein, the terms "upstream", "downstream", "proximal" and "distal" are used to describe the relative positions of components, or portions of components, of the aerosol-generating system and the aerosol-generating article according to the invention.

The aerosol-generating system according to the invention may comprise an aerosol-generating article. In general, an aerosol-generating article is introduced into a cavity of an inductive heating device of the aerosol-generating system such that heat may be induced in the susceptor by a corresponding inductor of a power supply electronics arranged in the inductive heating device. The aerosol-generating article comprised in the aerosol-generating system may be as described below.

According to one aspect, the invention relates to an aerosol generating article.

The aerosol-generating article comprises a cartridge comprising a first compartment comprising the nicotine source and a second compartment comprising the second substance source. The susceptor is arranged in between the first compartment and the second compartment.

As used herein, the term "first compartment" is used to describe one or more chambers or containers within the aerosol-generating article comprising the nicotine source.

As used herein, the term "second compartment" is used to describe one or more chambers or containers within the aerosol-generating article comprising the second substance source.

The first compartment and the second compartment may abut one another. Alternatively, the first compartment and the second compartment may be spaced apart from one another.

In use, typically nicotine vapour is released from the nicotine source in the first compartment and second substance vapour is released from the second substance source in the second compartment. The nicotine vapour reacts with the second substance vapour in the gas phase to form an aerosol, which is delivered to a user. Preferably, the aerosol-generating system according to the present invention further comprises a reaction chamber downstream of the first compartment and the second compartment configured to facilitate reaction between the nicotine vapour and the second substance vapour. The aerosol-generating article may comprise the reaction chamber. Where the aerosol-generating device comprises a device housing and a mouthpiece portion, the mouthpiece portion of the aerosol-generating device may comprise the reaction chamber.

As described further below, the first compartment and the second compartment may be arranged in series or parallel within the aerosol-generating article. Preferably, the first compartment and the second compartment are arranged in parallel within the cartridge.

By "series" it is meant that the first compartment and the second compartment are arranged within the aerosol-generating article so that in use an air stream drawn through the aerosol-generating article passes through one of the first compartment and the second compartment and then passes through the other of the first compartment and the second compartment. Nicotine vapour is released from the nicotine source in the first compartment into the air stream drawn through the aerosol-generating article and second substance vapour is released from the second substance source in the second compartment into the air stream drawn through the aerosol-generating article. The nicotine vapour reacts with the second substance vapour in the gas phase to form an aerosol, which is delivered to a user.

As used herein, by "parallel" it is meant that the first compartment and the second compartment are arranged within the aerosol-generating article so that in use a first air stream drawn through the aerosol-generating article passes through the first compartment and a second air stream drawn through the aerosol-generating article passes through the second compartment. Nicotine vapour is released from the nicotine source in the first compartment into the first air stream drawn through the aerosol-generating article and second substance vapour is released from the second substance source in the second compartment into the second air stream drawn through the aerosol-generating article. The nicotine vapour in the first air stream reacts with the second substance vapour in the second air stream in the gas phase to form an aerosol, which is delivered to a user.

The cartridge may further comprise a third compartment, preferably comprising an aerosol-modifying agent source. The first compartment, the second compartment and the third compartment are preferably arranged in parallel within the cartridge.

Where the aerosol-generating article comprises a third compartment, the third compartment may comprise one or more aerosol-modifying agents. For example, the third compartment may comprise one or more sorbents, such as activated carbon, one or more flavourants, such as menthol, or a combination thereof. A third compartment may also comprise an additional nicotine source. Preferably, the aerosol-modifying agent source in the third compartment is heated by the susceptor. Preferably, the susceptor is in direct contact, preferably in direct physical contact with the aerosol-modifying agent source. The susceptor may be in direct contact with a sorption element arranged in the third compartment.

The cartridge of the aerosol-generating article may have any suitable shape. Preferably, the cartridge may be substantially cylindrical. The first compartment, the second compartment and, where present, the third compartment preferably extend longitudinally between the opposed substantially planar end faces of the cartridge.

One or both of the opposed substantially planar end faces of the cartridge may be sealed by one or more frangible or removable barriers.

One or both of the first compartment comprising the nicotine source and the second compartment comprising the second substance source may be sealed by one or more frangible barriers. The one or more frangible barriers may be formed from any suitable material. For example, the one or more frangible barriers may be formed from a metal foil or film.

Preferably, the frangible barrier is formed of a material comprising no, or a limited amount of ferromagnetic material or paramagnetic material. In particular, the frangible barrier may comprise less than 20 percent, in particular less than 10 percent or less than 5 percent or less than 2 percent of ferromagnetic or paramagnetic material.

The aerosol-generating device preferably further comprises a piercing member configured to rupture the one or more frangible barriers sealing one or both of the first compartment and the second compartment. One or both of the first compartment comprising the nicotine source and the second compartment comprising the second substance source may be sealed by one or more removable barriers. For example, one or both of the first compartment comprising the nicotine source and the second compartment comprising the second substance source may be sealed by one or more peel-off seals.

The one or more removable barriers may be formed from any suitable material. For example, the one or more removable barriers may be formed from a metal foil or film.

The cartridge may have any suitable size. The cartridge may have a length of, for example, between about 5 mm and about 30 mm. In certain embodiments the cartridge may have a length of about 20 mm. The cartridge may have a diameter of, for example, between about 4 mm and about 10 mm. In certain embodiments the cartridge may have a diameter of about 7 mm. As used herein with reference to the present invention, by "length" is meant the maximum longitudinal dimension between the distal end and the proximal end of components, or portions of components, of the aerosol-generating system.

According to another aspect of the present invention, there is provided an aerosol-generating article for use in an aerosol-generating system according to the invention. The aerosol-generating article comprises a cartridge. The cartridge comprises a first compartment comprising a nicotine source and a second compartment comprising a second substance source. A first susceptor is arranged between the first compartment and the second compartment.

Advantages and aspects of the aerosol-generating article have already been described relating to the aerosol-generating system according to the invention and will not be repeated.

The cartridge comprises a separation wall, separating the first compartment from the second compartment. The separation wall may at least partially be formed by the susceptor. The separation wall may entirely be formed by the susceptor.

Remaining portions of the separation wall, not formed by the susceptor, may comprise or may be made of thermally conducting or thermally insulating material. Preferably, such separation wall parts are made of thermally conducting material.

Thermal conductivity is the property of a material to conduct heat. Heat transfer occurs at a lower rate across materials of low thermal conductivity than across materials of high thermal conductivity. The thermal conductivity of a material may depend on temperature.

Thermally conductive materials as used in the present invention, in particular for separation wall parts or further cartridge materials, preferably have thermal conductivities of more than 10 Watt per (meter×Kelvin), preferably more than 100 Watt per (meter×Kelvin), for example between 10 and 500 Watt per (meter×Kelvin).

Suitable thermally conductive materials include, but are not limited to, metals such as, for example, aluminium, chromium, copper, gold, iron, nickel and silver, alloys, such as brass and steel and combinations thereof.

Thermally conducting material favours heat transfer and distribution between the two compartments and may support a homogenous heat temperature distribution in the two compartments.

The susceptor may be an elongate susceptor, preferably in the shape of a susceptor strip.

A separation wall or the susceptor, respectively, may be arranged on a symmetry axis of the cartridge. The susceptor may lie in or form a symmetry plane of the cartridge. In such embodiments, a first compartment and a second compartment is identical in size and shape.

The cartridge or parts of the cartridge may be formed from one or more suitable materials. Suitable materials include, but are not limited to, aluminium, polyether ether ketone (PEEK), polyimides, such as Kapton®, polyethylene terephthalate (PET), polyethylene (PE), polypropylene (PP), polystyrene (PS), fluorinated ethylene propylene (FEP), polytetrafluoroethylene (PTFE), epoxy resins, polyurethane resins and vinyl resins.

Preferably, the cartridge is formed of a material comprising no, or a limited amount of ferromagnetic or paramagnetic material. In particular, the cartridge may comprise less than 20 percent, in particular less than 10 percent or less than 5 percent or less than 2 percent of ferromagnetic or paramagnetic material.

The cartridge may be formed from one or more materials that are nicotine-resistant and resistance to the second substance, for example, lactic acid-resistant.

The first compartment comprising the nicotine source may be coated with one or more nicotine-resistant materials and the second compartment comprising the second substance source may be coated with one or more second substance-resistant, for example, lactic acid-resistant materials.

Examples of suitable nicotine-resistant materials and lactic acid-resistant materials include, but are not limited to, polyethylene (PE), polypropylene (PP), polystyrene (PS), fluorinated ethylene propylene (FEP), polytetrafluoroethylene (PTFE), epoxy resins, polyurethane resins, vinyl resins and combinations thereof.

Use of one or more nicotine-resistant materials and second substance-resistant materials to form the cartridge or coat the interior of the first compartment and the second compartment, respectively, may advantageously enhance shelf life of the aerosol-generating article.

An outer cartridge wall may comprise thermally conductive or thermally insulating material. A thermally conductive material may support a homogeneous heat distribution in a compartment. An outer cartridge wall made of thermally insulating material on the other hand may be favourable in view of energy consumption of the system. It may also be favourable in view of a more convenient handling of such a system. Through a thermal insulation, heat generated in the cartridge is kept in the cartridge. Less or no heat loss to the environment is available through heat conduction. In addition, a heating up of a housing of an aerosol-generating device may be limited or avoided.

If the outer cartridge wall is formed from one or more thermally insulating materials, the interior of the first compartment and the second compartment may be coated with one or more thermally conductive materials to improve heat distribution in the respective compartments.

Use of one or more thermally conductive materials to coat the interior of the first compartment and the second compartment advantageously increases heat transfer from the susceptor to the nicotine source and the second substance source.

Thermally insulating materials as used in the present invention, in particular for cartridge materials, preferably have thermal conductivities of less than 1 Watt per (meter×Kelvin), preferably less than 0.1 Watt per (meter×Kelvin), for example between 1 and 0.01 Watt per (meter×Kelvin).

Cartridges for use in aerosol-generating systems according to the present invention and aerosol-generating articles according to the present invention may be formed by any suitable method. Suitable methods include, but are not limited to, deep drawing, injection moulding, blistering, blow forming and extrusion.

The aerosol-generating article may comprise a mouthpiece. The mouthpiece may comprise a filter. The filter may have a low particulate filtration efficiency or very low particulate filtration efficiency. The mouthpiece may comprise a hollow tube. The mouthpiece of the aerosol-generating article or of an aerosol-generating device may comprise a reaction chamber.

Figure 4:
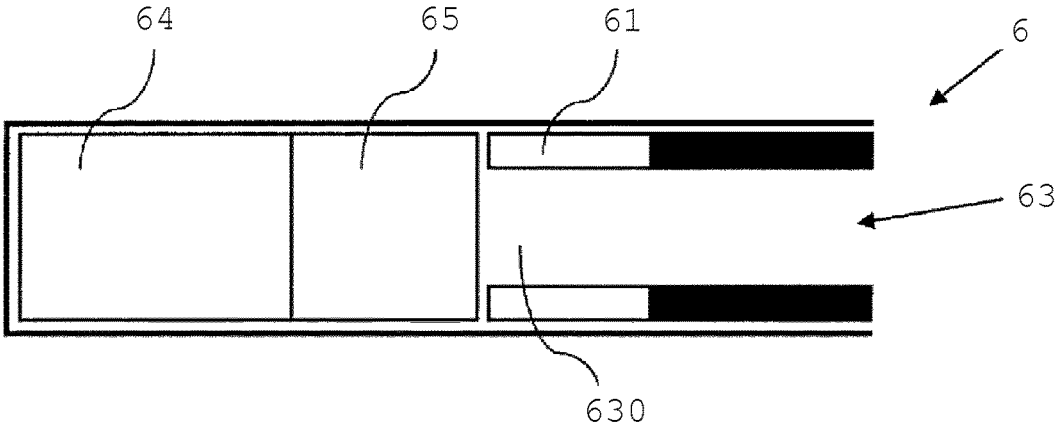

FIG. 4 schematically shows an aerosol-generating device for use in the aerosol-generating system according to the invention.

Figure 1:
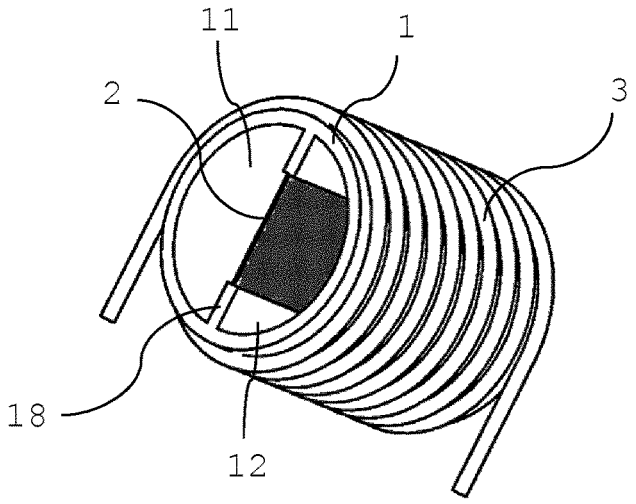
FIG. 1 shows a perspective view of a two-compartment cartridge with circumferentially arranged inductor coil winding.
Figure 2:
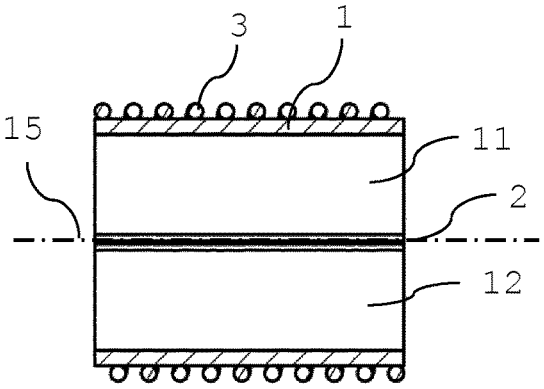
FIG. 2 shows a longitudinal cross section through the cartridge of FIG. 1.
Figure 3:
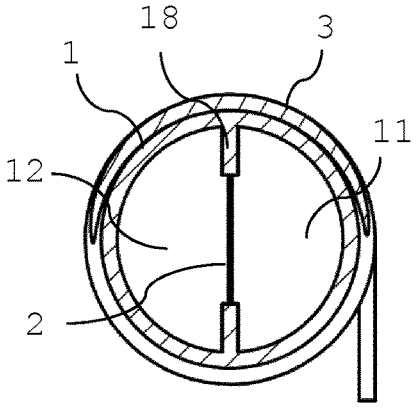
FIG. 3 shows a transverse cross section through the cartridge of FIG. 1.
Figure 5:
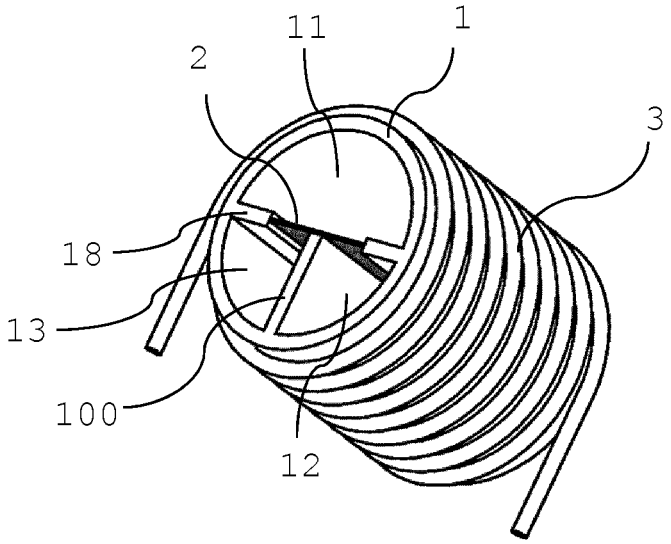
Figure 6:
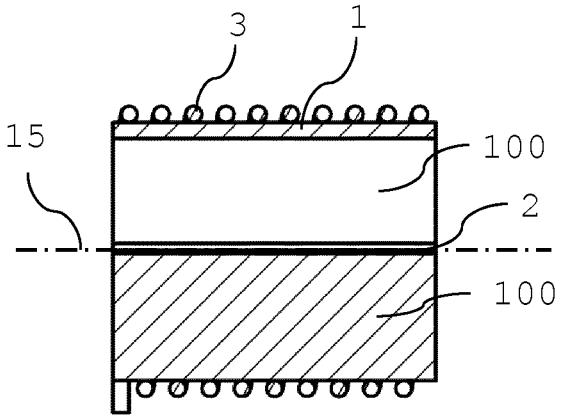
Figure 7:
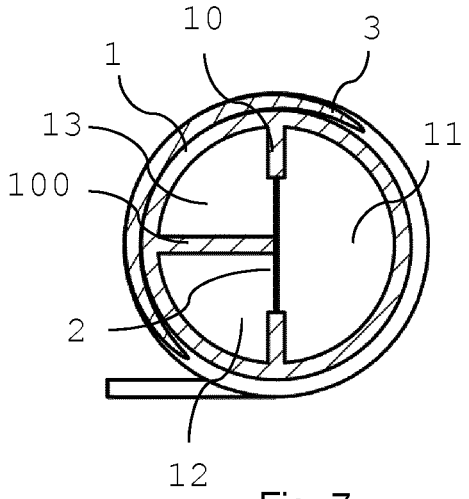

FIG. 5 shows a perspective view of a three-compartment cartridge with circumferentially arranged inductor coil winding;

FIG. 6 shows a longitudinal cross section through the cartridge of FIG. 5;

FIG. 7 shows a transverse cross section through the cartridge of FIG. 5;

In FIG. 1 to FIG. 3 a cartridge with a tubular housing 1 is illustrated. The housing 1 is divided by a susceptor 22 and two separation wall parts 18 into two chambers of semi-circular transverse cross-section 11, 12 disposed on either side of the susceptor 2 and the two separation wall parts 18. The chambers 11, 12 extend longitudinally between the opposed substantially planar end faces of the cartridge. One of the two chambers forms the first compartment 11 comprising the nicotine source. The other of the two chambers forms the second compartment 12 comprising the second source, for example lactic acid source.

The nicotine source may comprise a sorption element (not shown), such as a porous plastic sorption element, with nicotine adsorbed thereon, which is arranged in the chamber forming the first compartment 11. The second substance source may comprise a sorption element (not shown), such as a porous plastic sorption element, with lactic acid adsorbed thereon, which is arranged in the chamber forming the second compartment 12.

The susceptor 2 as well as the two separation wall parts are arranged longitudinally within the cartridge and extend parallel to the major axis 15 of the cartridge. The susceptor 2 is arranged symmetrically between the two separation wall parts 18.

The susceptor 2 is shaped as susceptor strip, for example, metal strip. The strip is arranged symmetrically between the first and second compartment 11, 12. The separation wall parts 18 are arranged in the plane formed by the large side of the susceptor strip.

In the embodiment shown in FIGS. 1 to 3, the susceptor 2 has a length, which corresponds to the length of the cartridge, as may best be seen in FIG. 2.

The separation wall parts 18 as well as the tubular housing 1 may be made of thermally conducting or thermally insulating material. Preferably, the separation wall parts 18 and the tubular housing are made of thermally insulating polymer materials. Housing 1 and separation wall 10 may be formed integrally, for example by a molding process.

The cartridge is surrounded by an inductor in the form of a single induction coil 3 for inducing heat in the susceptor 2 arranged between the first and the second compartments 11, 12.

Preferably, the induction coil 3 is part of an aerosol-generating device. The cartridge or the susceptors 2 of the cartridge, respectively, is brought into proximity with the coil 3 by insertion of the cartridge into a cavity of the device provided for receiving the cartridge.

A schematic longitudinal cross-sectional illustration of an electrically-operated aerosol-generating device 6 is shown in FIG. 4. The aerosol-generating device 6 comprises an inductor 61, for example an induction coil 3. The inductor 61 is located adjacent a distal portion 630 of cartridge receiving chamber 63 of the aerosol-generating device 6. In use, the user inserts an aerosol-generating article comprising a cartridge, for example as described in FIG. 1 to FIG. 3, into the cartridge receiving chamber 630 of the aerosol-generating device 6 such that the susceptor 2 in the cartridge of the aerosol-generating article is located adjacent to the inductor 61.

The aerosol-generating device 6 comprises a battery 64 and electronics 65 that allow the inductor 61 to be actuated. Such actuation may be manually operated or may occur automatically in response to a user drawing on an aerosol-generating article inserted into the cartridge receiving chamber 63 of the aerosol-generating device 6.

When actuated, a high-frequency alternating current is passed through coils of wire that form part of the inductor 61. This causes the inductor 61 to generate a fluctuating electromagnetic field within the distal portion 630 of the cartridge receiving chamber 63 of the device. When an aerosol-generating article is correctly located in the cartridge receiving chamber 63, the susceptor of the article is located within this fluctuating electromagnetic field. The fluctuating field generates at least one of eddy currents and hysteresis losses within the susceptor 2, which is heated as a result. The heated susceptor heats the nicotine source and second substance source of the aerosol-generating article to a sufficient temperature to form an aerosol.

The aerosol generated by heating the two sources is drawn downstream through the aerosol-generating article, for example versus the direction of and trough a mouthpiece and may be inhaled by a user.

In FIG. 5 to FIG. 7 a cartridge with a tubular housing having three compartments is illustrated. The same reference numerals are used for the same or similar elements.

The housing 1 is divided by the susceptor 2 and two separation wall parts 18 into two halves of semi-circular transverse cross-section disposed on either side of the susceptor 2 and the two separation wall parts 18. The first half corresponds to the first chamber 11. The second half is further divided by a further separation wall 100 into two chambers of quarter-circular cross section 12, 13.

The chambers 11, 12, 13 extend longitudinally between the opposed substantially planar end faces of the cartridge. One of the three chambers forms the first compartment 11 comprising the nicotine source. The second of the three chambers forms the second compartment 12 comprising the second source, for example lactic acid source. The third of the three compartments forms the third compartment 13 comprising the third source, for example an aerosol-modifying agent source such as an activated carbon source.

The third substance source may also comprise a sorption element (not shown), such as a porous plastic sorption element, with aerosol-modifying agent adsorbed thereon, which is arranged into the chamber forming the third compartment 13.

The susceptor 2, the two separation wall parts 18 and the further separation wall 100 are arranged longitudinally within the cartridge and extend parallel to the major axis 15 of the cartridge.

The further separation wall 100 is arranged perpendicular to the susceptor 2.

In the embodiment shown in FIGS. 5 to 7, the susceptor 2 has a length, which corresponds to the length of the cartridge, as may best be seen in FIG. 6 (which shows the cross-section of the cartridge along the further separation wall 100).

The further separation wall 100 may be made of thermally conducting or thermally insulating material. For example, the further separation wall 100 may be made of thermally insulating polymer materials. Housing 1, separation wall parts 18 and further separation wall 100 may be formed integrally, for example by a molding process.

The invention claimed is:

1. Aerosol-generating system comprising:

a nicotine source;

a second substance source;

a susceptor for heating the nicotine source and the second substance source;

a power source connected to a load network, the load network comprising an inductor for being inductively coupled to the susceptor; and an aerosol-generating article comprising a cartridge comprising a separation wall at least partially formed by the susceptor, the separation wall separating the first compartment from the second compartment, and the susceptor being in direct contact with the nicotine source and the second substance source.

2. Aerosol-generating system according to claim 1, wherein the susceptor is configured to heat the nicotine source and the second substance source to substantially a same temperature.

3. Aerosol-generating system according to claim 1, wherein the susceptor is in direct contact with at least one of the nicotine source and the second substance source.

4. Aerosol-generating system according to claim 1, wherein the second substance source is a lactic acid source and an aerosol generated in the aerosol-generating system comprises nicotine lactate acid salt particles.

5. Aerosol-generating system according to claim 1, wherein the first compartment comprises the nicotine source and the second compartment comprises the second substance source, wherein the susceptor is arranged between the first compartment and the second compartment.

6. Aerosol-generating system according to claim 5, wherein the first compartment and the second compartment are arranged in parallel.

7. Aerosol-generating system according to claim 5, wherein the cartridge comprises a third compartment comprising an aerosol-modifying agent source.

8. Aerosol-generating system according to claim 5, wherein the cartridge is substantially cylindrical and one or both of the opposed substantially planar end faces of the cartridge is sealed by one or more frangible or removable barriers.

9. Aerosol-generating system according to claim 1, wherein a size of a contact surface of the susceptor is the same for the nicotine source and the second substance source.

10. Aerosol-generating system according to claim 1, wherein a size of a contact surface of the susceptor is different for the nicotine source and the second substance source.

11. Aerosol-generating system according to claim 1, wherein the cartridge comprises two opposed end faces, and wherein the first compartment and the second compartment extend from one end face to the other opposed end face.

12. Aerosol-generating system according to claim 1, wherein the susceptor and the inductor extend along the entire length of the cartridge.

13. Aerosol-generating article comprising a cartridge, the cartridge comprising:

a first compartment comprising a nicotine source;

a second compartment comprising a second substance source;

a susceptor arranged between the first compartment and the second compartment and a separation wall at least partially formed by the susceptor, the separation wall separating the first compartment from the second compartment, and the susceptor being in direct contact with the nicotine source and the second substance source.

14. Aerosol-generating article according to claim 13, wherein the susceptor is arranged on a symmetry axis of the cartridge.

15. Aerosol-generating article according to claim 13, wherein the susceptor is an elongate susceptor, preferably in the shape of a susceptor strip.

16. Aerosol-generating article according to claim 13, wherein an outer cartridge wall comprises thermally insulating material.

17. Aerosol-generating article according to claim 13, wherein a size of a contact surface of the susceptor is the same for the nicotine source and the second substance source.

18. Aerosol-generating article according to claim 13, wherein a size of a contact surface of the susceptor is different for the nicotine source and the second substance source.

19. Aerosol-generating article according to claim 13, wherein the cartridge comprises two opposed end faces, and wherein the first compartment and the second compartment extend from one end face to the other opposed end face.

20. Aerosol-generating article according to claim 13, wherein the susceptor extends along the entire length of the first compartment and of the second compartment.

* * * * *